US012774835B2

(12) United States Patent
Kopko et al.

(10) Patent No.: US 12,774,835 B2
(45) Date of Patent: Oct. 27, 2026

(54) MECHANICAL-COOLING, FREE-COOLING, AND HYBRID-COOLING OPERATION OF A CHILLER

(71) Applicant: Tyco Fire & Security GmbH, Neuhausen am Rheinfall (CH)

(72) Inventors: William L. Kopko, Jacobus, PA (US); Jing Li, Red Lion, PA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 67 days.

(21) Appl. No.: 18/630,826

(22) Filed: Apr. 9, 2024

(65) Prior Publication Data

US 2024/0255197 A1 Aug. 1, 2024

Related U.S. Application Data

(62) Division of application No. 17/321,098, filed on May 14, 2021, now Pat. No. 11,953,243.

(51) Int. Cl.
*F25B 6/04* (2006.01)
*F24F 3/06* (2006.01)
(Continued)

(52) U.S. Cl.
CPC ..... *F25B 41/24* (2021.01); *F25B 6/04* (2013.01); *F25B 40/02* (2013.01); *F25B 41/22* (2021.01); *F24F 3/06* (2013.01); *F25B 39/04* (2013.01)

(58) Field of Classification Search
CPC .. F25B 40/02; F25B 6/02; F25B 49/02; F24F 5/001
See application file for complete search history.

(56) References Cited

U.S. PATENT DOCUMENTS 9,179,580 B2 11/2015 Tozer
10,101,060 B2 10/2018 Feng et al.
(Continued)

FOREIGN PATENT DOCUMENTS

CN 102549356 A 7/2012
DE 112015000750 T5 11/2016
(Continued)

OTHER PUBLICATIONS

Trane, "free" cooling using Water Economizers, Engineers Newsletter, 2008, pp. 1-8, vol. 37-3. Website: https://www.trane.com/Commercial/Uploads/PDF/11598/News-%20Free%20Cooling%20using%20Water%20Economizers.pdf.
(Continued)

*Primary Examiner* — Ana M Vazquez
(74) *Attorney, Agent, or Firm* — Fletcher Yoder, PC

(57) ABSTRACT

A chiller system includes a mechanical-cooling circuit configured to circulate a refrigerant through an evaporator of the mechanical-cooling circuit, where the evaporator is configured to cool a conditioning fluid with the refrigerant. The chiller system also includes a free-cooling circuit configured to circulate the refrigerant through a heat exchanger of the free-cooling circuit, where the heat exchanger is configured to cool the conditioning fluid with the refrigerant. The chiller system also includes a distribution header having a first inlet configured to receive the refrigerant from the mechanical-cooling circuit, a second inlet configured to receive the refrigerant from the free-cooling circuit, and an internal volume fluidly coupled to the first inlet and the second inlet. A fan coil unit of the chiller system is configured to receive the refrigerant from the internal volume of the distribution header.

20 Claims, 8 Drawing Sheets

(51) Int. Cl.

| | |
|---|---|
| ***F25B 39/04*** | (2006.01) |
| ***F25B 40/02*** | (2006.01) |
| ***F25B 41/22*** | (2021.01) |
| ***F25B 41/24*** | (2021.01) |

(56) References Cited

U.S. PATENT DOCUMENTS

| | | | | |
|---|---|---|---|---|
| 2004/0003604 | A1 | 1/2004 | So et al. | |
| 2011/0120162 | A1* | 5/2011 | Ueda | F25B 49/025 702/182 |
| 2019/0186801 | A1* | 6/2019 | Kopko | F25B 49/027 |
| 2020/0400348 | A1 | 12/2020 | Sakuma et al. | |
| 2021/0088260 | A1 | 3/2021 | Silva et al. | |

FOREIGN PATENT DOCUMENTS

| | | | |
|---|---|---|---|
| KR | 20180121606 | A | 11/2018 |
| WO | 2009009164 | A1 | 1/2009 |

OTHER PUBLICATIONS

Carrier, "Air-Cooled Scroll Chillers with Greenspeed Intelligence", pp. 1-40. Website: https://www.carrier.com/commercial/en/kw/media/02.%2030RBM_RBP_160_520_tcm477-51107.pdf (Accessed on May 13, 2021).

Steven T. Taylor, P.E., Fellow Ashrae, "How to Design & Control Waterside Economizers", Column Engineer's Notebook, 2014, pp. 1-7. Website: https://www.taylor-engineering.com/wp-content/uploads/2020/04/ASHRAE_Journal_-_How_to_Design_Control_Waterside_Economizers.pdf.

Trane, "CenTraVac™ Water-cooled Liquid Chillers", Product Catalog, Mar. 2020, pp. 1-120. Website: https://www.trane.com/content/dam/Trane/Commercial/global/products-systems/equipment/chillers/water-cooled/centrifugal-liquid/CTV-PRC007R-EN_03142020.pdf.

MBS, "Carrier develops integrated free cooling for chillers", Aug. 14, 2005, pp. 1-2.

International Search Report and Written Opinion for PCT Application No. PCT/US2022/029049, mailed Aug. 30, 2022, 12 pages.

* cited by examiner

MECHANICAL-COOLING, FREE-COOLING, AND HYBRID-COOLING OPERATION OF A CHILLER

CROSS-REFERENCE TO RELATED APPLICATIONS

This is a divisional application of U.S. patent application Ser. No. 17/321,098, entitled "MECHANICAL-COOLING, FREE-COOLING, AND HYBRID-COOLING OPERATION OF A CHILLER," filed May 14, 2021, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

This application relates generally to chiller systems and, more particularly, to mechanical-cooling, free-cooling, and hybrid-cooling operation of chiller systems.

Chiller systems may utilize a vapor compression system employing a mechanical-cooling circuit. The mechanical-cooling circuit may circulate a working fluid (e.g., a refrigerant) that changes phases between vapor, liquid, and combinations thereof in response to exposure to different temperatures and pressures within components of the mechanical-cooling circuit. For example, the mechanical-cooling circuit may include an evaporator configured to place the working fluid in a heat exchange relationship with a conditioning fluid (e.g., water), such that the working fluid boils while absorbing heat from the conditioning fluid. The conditioning fluid, cooled by the working fluid, may then be delivered to a load. In such applications, the conditioning fluid may be passed through downstream equipment, such as air handlers, to condition other fluids, such as air delivered to a conditioned space in a building.

The mechanical-cooling circuit may also include a condenser having a coil configured to place the working fluid in a heat exchange relationship with a cooling fluid (e.g., water or air) that cools the working fluid in the condenser and causes the working fluid to condense into a liquid. That is, the working fluid may boil as the working fluid extracts heat from the conditioning fluid in the evaporator and may condense as the working fluid discharges heat to the cooling fluid in the condenser. In embodiments employing a water-cooled condenser, water used to cool the working fluid may be routed to a cooling tower that cools the water for subsequent return to the condenser. In embodiments employing an air-cooled condenser, air may be blown or drawn over the coil of the condenser and expelled to environment. A compressor of the mechanical-cooling circuit may be employed to move the working fluid through the above-described components of the mechanical-cooling circuit. For example, the compressor may be configured to receive the refrigerant in a vapor phase downstream from the evaporator.

In certain chiller systems, a free-cooling circuit may be employed during certain conditions to more efficiently provide the conditioning fluid at adequate temperatures for delivery to the load. For example, when an ambient temperature is sufficiently low, the sufficiently low ambient temperature may be used to obtain adequate temperatures of the conditioning fluid without having to operate the compressor of the vapor compression system (or, in certain embodiments, while operating the compressor at a reduced or minimum setting). In certain conventional embodiments, a heat exchanger of the free-cooling circuit may receive the above-described conditioning fluid and a cooling fluid (e.g., the above-described cooling fluid including water or air, or a separate cooling fluid, such as glycol or a mixture of glycol and water), where the cooling fluid cools the conditioning fluid to adequate temperatures for delivery to the load.

Although a number of different chiller arrangements employing free-cooling are possible, in general, conventional chiller systems employing a mechanical-cooling circuit and a free-cooling circuit may include at least one condensing coil of the mechanical-cooling circuit and at least one free-cooling coil of the free-cooling circuit (e.g., where the free-cooling coil is separate from the condensing coil). Additionally or alternatively, in some conventional embodiments, the mechanical-cooling circuit and the free-cooling circuit may employ different fluids for cooling the conditioning fluid. For example, the free-cooling circuit may employ a glycol loop separate from the refrigerant loop employed by the mechanical-cooling circuit. Additionally or alternatively, in some conventional embodiments, the chiller system may only be configured to operate in a free-cooling mode or a mechanical-cooling mode, as opposed to utilizing both the free-cooling circuit and the mechanical-cooling circuit in tandem. Additionally or alternatively, in some conventional embodiments, the free-cooling circuit may be used primarily or exclusively for rejecting heat from the conditioning fluid (i.e., the free-cooling circuit may not directly reject heat from an aspect of the mechanical-cooling circuit, such as the condenser). The above-described aspects of conventional chiller systems employing free-cooling circuits may contribute to a higher cost, decreased performance, decreased versatility, relatively complex arrangements, relatively complex installation procedures, and relatively complex maintenance procedures associated with the conventional chiller system. Accordingly, it is now recognized that improved chiller systems are desired.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a chiller system includes a mechanical-cooling circuit configured to circulate a refrigerant through an evaporator of the mechanical-cooling circuit, where the evaporator is configured to cool a conditioning fluid with the refrigerant. The chiller system also includes a free-cooling circuit configured to circulate the refrigerant through a heat exchanger of the free-cooling circuit, where the heat exchanger is configured to cool the conditioning fluid with the refrigerant. The chiller system also includes a distribution header having a first inlet configured to receive the refrigerant from the mechanical-cooling circuit, a second inlet configured to receive the refrigerant from the free-cooling circuit, and an internal volume fluidly coupled to the first inlet and the second inlet. A fan coil unit of the chiller system is configured to receive the refrigerant from the internal volume of the distribution header.

In another embodiment, a chiller system includes a first condenser coil, a second condenser coil, a first subcooler coil, a second subcooler coil, and a control system. The control system is configured to cause, in response to a mechanical-cooling operation of the chiller system, a refrigerant to flow through the first condenser coil and the second condenser coil in parallel, and then through the first subcooler coil and the second subcooler coil in series. The control system is also configured to cause, in response to a free-cooling operation of the chiller system, the refrigerant to flow through the first subcooler coil and the second subcooler coil in series.

In another embodiment, a chiller system includes a mechanical-cooling circuit having a compressor, a condenser, and an evaporator. The compressor is configured to bias a refrigerant through the condenser and the evaporator, where the evaporator is configured to cool a conditioning fluid with the refrigerant. The chiller system also includes a free-cooling circuit configured to route a fluid between the condenser of the mechanical-cooling circuit such that the fluid extracts heat from the refrigerant at the condenser, a heat exchanger of the free-cooling circuit such that the fluid extracts heat from the conditioning fluid at the heat exchanger, and a dry tower configured to generate an air flow that extracts heat from the fluid at the dry tower.

BRIEF DESCRIPTION OF THE DRAWINGS

Various aspects of this disclosure may be better understood upon reading the following detailed description and upon reference to the drawings in which.

DETAILED DESCRIPTION

Figure 1:
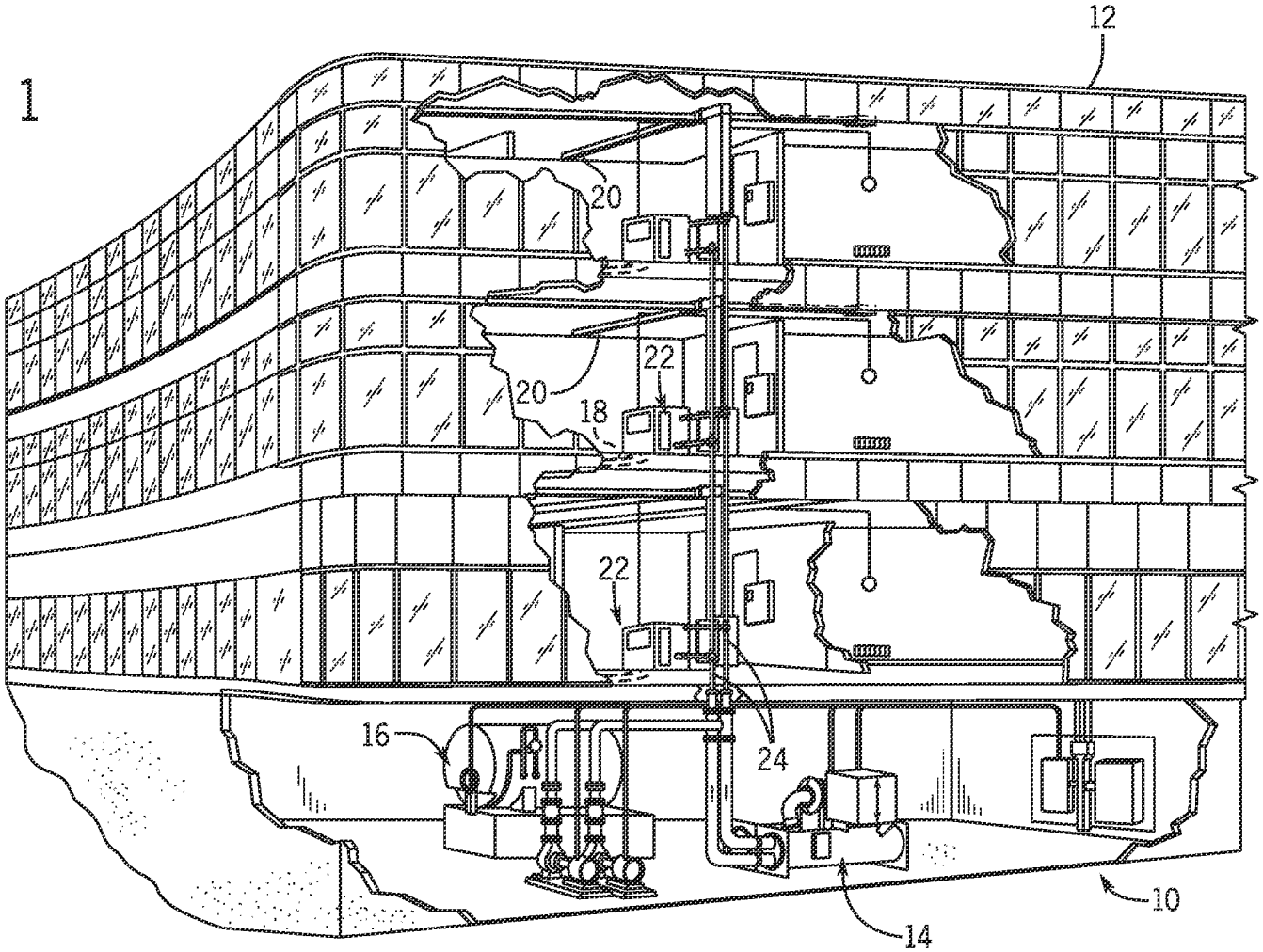
FIG. 1 is a perspective view of an embodiment of a building that may utilize a heating, ventilating, air conditioning, and/or refrigeration (HVAC&R) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to chiller systems having a vapor compression system (e.g., employing a mechanical-cooling circuit) and a free-cooling circuit. The chiller systems may include a mechanical-cooling operation in which the mechanical-cooling circuit is employed and the free-cooling circuit is not employed, a free-cooling operation in which the free-cooling circuit is employed and the mechanical-cooling circuit is not employed (or in which the mechanical-cooling circuit is employed while a compressor thereof is unpowered or powered to a minimum or reduced setting), and a hybrid-cooling operation in which both the mechanical-cooling circuit and the free-cooling circuit are employed in tandem. In general, the free-cooling circuit is employed (e.g., in the free-cooling operation and the hybrid-cooling operation) when ambient temperatures are sufficiently low and can be used to wholly or partially cool a conditioning fluid to adequate temperatures for delivery to a load (e.g., downstream equipment, such as air handling units, that cool an air flow via the conditioning fluid and deliver the air flow to a conditioned space).

Various embodiments of the above-described chiller system are possible. For example, in one embodiment of the present disclosure, a chiller system may include a number of fan coil units shared between a mechanical-cooling circuit and a free-cooling circuit, where the fan coil units may be configured to receive a refrigerant from the mechanical-cooling circuit during a mechanical-cooling operation and during a hybrid-cooling operation, and to receive the refrigerant from the free-cooling circuit during the free-cooling operation and the hybrid-cooling operation. Various features may be employed to bias the refrigerant toward the mechanical-cooling circuit, the free-cooling circuit, or both depending on the operating mode of the chiller (e.g., the free-cooling operation, the mechanical-cooling operation, or the hybrid-cooling operation). In general, the fan coil units may receive the refrigerant and cool the refrigerant via an outside air flow expelled to environment.

In another embodiment of the present disclosure, a chiller system may include two or more condenser coils and two or more subcooler coils employed to receive a refrigerant in various configurations or sequences in response to the chiller system being controlled to a mechanical-cooling operation, a free-cooling operation, or a hybrid-cooling operation. For example, when the chiller system is controlled to the mechanical-cooling operation, the refrigerant (e.g., a vapor phase of the refrigerant) may flow through at least two condenser coils in parallel, then through at least two subcooler coils in series, then through an evaporator, where the refrigerant in the evaporator cools a conditioning fluid for delivery to a load (e.g., downstream equipment, such as air handling units, that cool an air flow via the conditioning fluid and deliver the air flow to a conditioned space). The at least two condenser fan coils units may share fans with the at least two subcooler coils. That is, a first condenser coil and a first subcooler coil share a first fan, and a second condenser coil and a second subcooler coil may share a second fan. When the chiller system is controlled to the free-cooling operation, the refrigerant (e.g., a liquid phase of the refrigerant) may flow through a heat exchanger, such as a brazed plate heat exchanger, and then through the at least two subcooler coils in parallel, where the refrigerant cools the conditioning fluid for delivery to the load. During the free-cooling operation, the compressor may be unpowered. When the chiller system is controlled to the hybrid-cooling operation, the chiller system operates similar to the free-cooling operation except that the compressor motor is powered to assist in movement of the refrigerant through the chiller system.

In another embodiment of the present disclosure, a chiller system may employ a glycol loop including a number of fan coil units disposed between a condenser of a mechanical-cooling circuit and a heat exchanger of a free-cooling circuit. The fan coil units may be configured to receive the glycol from the condenser (e.g., via a condenser pump) during a mechanical-cooling operation, from the heat exchanger (e.g., via a free-cooling pump) during a free-cooling operation, and from both the condenser and the heat exchanger during a hybrid-cooling operation. In general, the glycol may cool a refrigerant of the mechanical-cooling circuit in the condenser during the mechanical-cooling operation and during the hybrid-cooling operation. The glycol may cool a conditioning fluid in the heat exchanger during the free-cooling operation and the hybrid-cooling operation, where the conditioning fluid is routed to an evaporator of the mechanical-cooling circuit for further cooling and/or delivered to a load (e.g., downstream equipment, such as air handling units, that cool an air flow via the conditioning fluid and deliver the air flow to a conditioned space).

In another embodiment of the present disclosure, a chiller system may employ a free-cooling circuit having a glycol loop that routes glycol (or mixture of water and glycol) between a condenser of a mechanical-cooling circuit, a heat exchanger (e.g., a glycol-water heat exchanger), and a dry tower. The glycol may cool a refrigerant of the mechanical-cooling circuit at the condenser. The glycol may also cool a conditioning fluid at the glycol-water heat exchanger, where the conditioning fluid is routed to an evaporator of the mechanical-cooling circuit for further cooling and/or delivered to a load (e.g., downstream equipment, such as air handling units, that cool an air flow via the conditioning fluid and deliver the air flow to a conditioned space). The dry tower (or multiple dry towers) may be employed to cool the glycol after the glycol passes through the condenser, the glycol-water heat exchanger, or both.

The above-described chiller systems in accordance with the present disclosure may enable reduced manufacturing costs, increased performance, increased versatility, relatively less complex arrangements, relatively less complex installation procedures, and relatively less complex maintenance procedures relative to conventional chiller systems. These and other features are described in detail below.

Turning now to the drawings, FIG. 1 is a perspective view of an embodiment of a heating, ventilating, air conditioning, and/or refrigeration (HVAC&R) system 10 in a building 12 for a typical commercial setting. The HVAC&R system may include a boiler 16 to supply warm liquid to heat the building 12 and a vapor compression system 14 to supply chilled liquid to cool the building 12. The vapor compression system 14, sometimes referred to as a chiller, may circulate a working fluid (e.g., refrigerant) that is cooled by a cooling fluid (e.g., liquid such as water) in a condenser of the vapor compression system 14, and that is heated by a conditioning fluid (e.g., liquid, such as water) in an evaporator of the vapor compression system 14. The cooling fluid may be provided by a cooling tower which cools the cooling fluid via, for example, ambient air. The conditioning fluid, cooled by the working fluid as noted above, may be utilized to cool an air flow provided to conditioned spaces of the building 12.

The HVAC&R system 10 may also include an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or the conditioning fluid (e.g., chilled liquid such as water) from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

In accordance with the present disclosure, the HVAC&R system 10 may employ a chiller system having a mechanical-cooling circuit and a free-cooling circuit. The chiller system may be configured to be controlled to a mechanical-cooling operation (e.g., employing the mechanical-cooling circuit but not the free-cooling circuit), a free-cooling operation (e.g., employing the free-cooling circuit but not the mechanical-cooling circuit, or employing the mechanical-cooling circuit while a compressor thereof is unpowered or powered to a minimum or reduced setting), and a hybrid-cooling operation (e.g., employing the mechanical-cooling circuit and the free-cooling circuit). Various chiller systems for use in the HVAC&R system 10 of FIG. 1 and configured to employ the mechanical-cooling operation, the free-cooling operation, and the hybrid-cooling operation are described in detail below. In general, the free-cooling operation and the hybrid-cooling operation, which employ the free-cooling circuit, may be activated when an ambient temperature is sufficiently low and can used to effectively reduce temperatures of a conditioning fluid (e.g., delivered to a load) without having to operate the mechanical-cooling circuit (or while a compressor of the mechanical-cooling circuit is unpowered or powered at a minimum or reduced setting). Chiller systems in accordance with the present disclosure may enable reduced manufacturing costs, increased performance, increased versatility, relatively less complex arrangements, relatively less complex installation procedures, and relatively less complex maintenance procedures relative to conventional chiller systems. These and other features are described in detail below.

Figure 2:
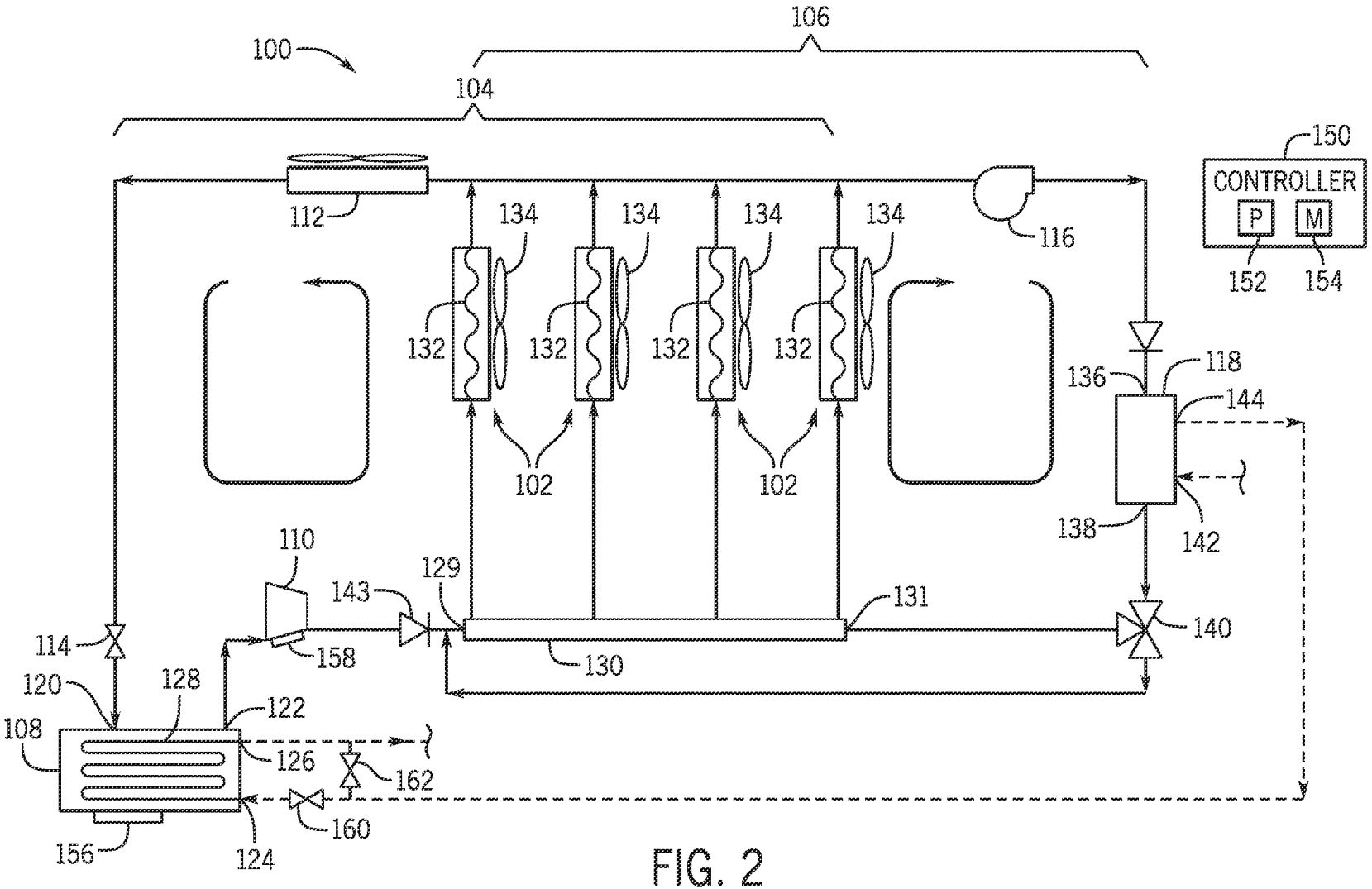
FIG. 2 is a schematic illustration of an embodiment of a chiller system for use in the HVAC&R system of FIG. 1, the chiller system having fan coil units configured to receive a refrigerant from a mechanical-cooling circuit and from a free-cooling circuit, in accordance with an aspect of the present disclosure.

FIG. 2 is a schematic illustration of an embodiment of a chiller system 100 for use in the HVAC&R system 10 of FIG. 1 and having fan coil units 102 configured to receive a refrigerant from a mechanical-cooling circuit 104 and a free-cooling circuit 106. In certain embodiments, the chiller system 100 is preferably an air-cooled chiller located outside of the building in a well ventilated area. If located inside the building, suitable ducting may be necessary for supplying air to the chiller and then rejecting it to the atmosphere. A flow of the refrigerant is denoted in the illustrated embodiment via a solid line, while a flow of a conditioning fluid, such as water or brine, is denoted in the illustrated embodiment (and other embodiments included below) via a dashed line. The mechanical-cooling circuit 104 includes an evaporator 108, a compressor 110, a subcooler 112, and an expansion valve 114, among other features described below. The free-cooling circuit 106 includes a pump 116 and a heat exchanger 118, among other features described below. As illustrated in FIG. 2, the fan coil units 102 are shared between the mechanical-cooling circuit 104 and the free-cooling circuit 106. During a mechanical-cooling operation, all the fan coil units 102 may receive the refrigerant (e.g., a vapor phase of the refrigerant) from the compressor 110 of the mechanical-cooling circuit 104, and act as condensers to condense the refrigerant into a liquid (or liquid-rich two-phase flow). During free-cooling operation, all the fan coil units 102 may receive the refrigerant (e.g., a liquid phase of the refrigerant) from the heat exchanger 118 of the free-cooling circuit 106 and/or from a valve 140 of the free-cooling circuit 106. During hybrid-cooling operation, a portion of the fan coil units 102 may be used as condensers corresponding to the mechanical-cooling circuit 104 and an additional portion of the fan coil units 102 may be used as free-cooling coils corresponding to the free-cooling circuit 106. These and other features are described in detail below.

Focusing first on the mechanical-cooling circuit 104, the evaporator 108 of the mechanical-cooling circuit 104 includes a refrigerant inlet 120 configured to receive the refrigerant, a refrigerant outlet 122 configured to output the refrigerant toward the compressor 110, a conditioning fluid inlet 124 configured to receive the conditioning fluid, and a conditioning fluid outlet 126 configured to output the conditioning fluid. The evaporator 108 also includes a tube bundle 128 coupled to the conditioning fluid inlet 124 and the conditioning fluid outlet 126. The tube bundle 128 may be a multi-pass coil or a single-pass with shell-side evaporation and water on the inside of the tubes. Alternatively the tube bundle may be direct exchange (DX) design with boiling refrigerant on the inside of the tubes and water on the outside of the tubes. If a DX design is used, there are preferably baffles to force water over the tubes, or the evaporator may be a brazed-plate heat exchanger (BPHX) or other plate design. In the evaporator 108, the refrigerant may extract heat from the conditioning fluid, causing the refrigerant to change from a liquid phase (or two-phase flow) to a vapor phase, and causing the conditioning fluid to be chilled. The conditioning fluid may be output through the conditioning fluid outlet 126 toward a load (e.g., downstream equipment, such as an air handling unit where the conditioning fluid cools an air flow supplied to a conditioned space).

The compressor 110 may operate to bias the refrigerant through the mechanical-cooling circuit 104. As shown, the compressor 110 may bias a vapor phase of the refrigerant toward a refrigerant inlet 129 of a distribution header 130 shared between the mechanical-cooling circuit 104 and the free-cooling circuit 106. For example, the distribution header 130 includes the refrigerant inlet 129 generally configured to receive the refrigerant from the compressor 110 and an additional refrigerant inlet 131 configured to receive the refrigerant from the heat exchanger 118 (or the valve 140) of the free-cooling circuit 106. The distribution header 130 may distribute the refrigerant to the fan coils 102 shared between the mechanical-cooling circuit 104 and the free-cooling circuit 106. Each fan coil 102 may include a coil 132 and a fan 134. The coil 132 of each fan coil 102 may include a microchannel coil configured to receive the refrigerant. The fan 134 of each fan coil 102 may bias an air flow over the corresponding coil 132 of each fan coil 102, thereby cooling the refrigerant and/or causing the refrigerant to condense to a liquid or liquid-rich two-phase flow.

In certain operating intervals (e.g., during the mechanical-cooling operation and/or the hybrid-cooling operation, described in detail below), at least a portion of the refrigerant may be directed from the fan coil units 102 to the subcooler 112 of the mechanical-cooling circuit 104. The subcooler 112 of the mechanical-cooling circuit 104 may also include a coil and fan configured to further cool the refrigerant prior to delivery of the refrigerant to the expansion valve 114 of the mechanical-cooling circuit 104. The expansion valve 114 may receive the liquid phase of the refrigerant from the subcooler 112, reduce a pressure of the liquid phase of the refrigerant, and pass the liquid phase of the refrigerant to the evaporator 108. While the refrigerant may be in the liquid phase at various intervals of the mechanical-cooling circuit 104, the evaporator 108 may boil the liquid phase of the refrigerant, as previously described, and the compressor 110 is generally configured to receive and output the refrigerant in a vapor phase.

In contrast to the compressor 110 of the mechanical-cooling circuit 104, the free-cooling circuit 106 includes the pump 116 configured to receive and output the refrigerant in the liquid phase. For example, in certain operating intervals (e.g., during free-cooling operation and/or hybrid-cooling operation, described in detail below), at least a portion of the refrigerant may be directed from the fan coil units 102 to the pump 116. The pump 116 may route the refrigerant, in the liquid phase, toward the heat exchanger 118. The heat exchanger 118 includes a refrigerant inlet 136 configured to receive the refrigerant and a refrigerant outlet 138 configured to output the refrigerant toward the additional refrigerant inlet 131 of the distribution header 130 (or a three-way valve 140 disposed between the heat exchanger 118 and the additional refrigerant inlet 131 of the distribution header 130). The heat exchanger 118 also includes a conditioning fluid inlet 142 configured to receive the conditioning fluid from the load (e.g., an air handling unit) and a conditioning fluid outlet 144 configured to output the conditioning fluid toward the evaporator 108 of the mechanical-cooling circuit 104. In general, the heat exchanger 118 is configured to chill the conditioning fluid via the refrigerant. That is, the refrigerant may be heated by the conditioning fluid in the heat exchanger 118. The refrigerant output by the heat exchanger 118 may be a warmed liquid phase or a liquid-rich two-phase flow.

As described above, the chiller system 100 may be controlled to the mechanical-cooling operation, the free-cooling operation, or the hybrid-cooling operation. In general, the refrigerant handled by the chiller system 100 may tend to migrate to areas of the chiller system 100 having a lower temperature and/or a lower pressure. In certain temperature or pressure conditions, the refrigerant may tend to naturally migrate to the free-cooling circuit 106, such that the chiller system 100 operates in the free-cooling operation (e.g., where the fan coil units 102 receive the refrigerant in the liquid phase and operate as free-cooling coils). In certain other temperature and pressure conditions, the refrigerant may tend to naturally migrate to the mechanical-cooling circuit 104, such that the chiller system 100 operates in the mechanical-cooling operation (e.g., where the fan coil units 102 operate as condensers and receive the refrigerant in the vapor phase from the compressor 110). In still other temperature and pressure conditions, a portion of the refrigerant may tend to migrate to the mechanical-cooling circuit 104 and an additional portion of the refrigerant may tend to migrate to the free-cooling circuit 106, such that the chiller system 100 operates in hybrid-cooling operation. However, while natural migration of the refrigerant may occur, aspects (e.g., control aspects) of the chiller system 100 may be employed to select between the mechanical-cooling operation, the free-cooling operation, and the hybrid-cooling operation by encouraging migration of the refrigerant to the mechanical-cooling circuit 104, the free-cooling circuit 106, or both.

For example, a controller 150 (e.g., a control system) of the chiller system 100 may include processing circuitry 152 and a memory 154 (e.g., non-transitory, computer-readable media), where the memory 154 stores instructions thereon that, when executed by the processing circuitry 152, cause the controller 150 to perform various functions. The controller 150 may receive sensor feedback from a pressure sensor 155 (e.g., indicative of a pressure of the refrigerant) and a temperature sensor 157 (e.g., indicative of a temperature of the refrigerant). The pressure sensor 155 and the temperature sensor 157 may be located anywhere in the chiller system 100. Based on the sensor feedback from the pressure sensor 155 and the temperature sensor 157, and/or based on other feedback, the controller 150 may control aspects of the chiller system 100 to enable the mechanical-cooling operation, the free-cooling operation, or the hybrid-cooling operation. For example, the controller 150 may energize a heater 156 disposed on or adjacent to the evaporator 108, a heater 158 disposed on or adjacent to the compressor 110, or both to enable the free-cooling operation. Indeed, by warming the evaporator 108 and/or the compressor 110 of the mechanical-cooling circuit 104, the refrigerant may tend to migrate to the lower temperature and/or pressure conditions in the free-cooling circuit 106. Further, one or more bypass valves 160, 162 associated with the conditioning fluid may be controlled by the controller 150 to either direct the conditioning fluid into the evaporator 108 or cause the conditioning fluid to bypass the evaporator 108, depending on the operating mode. In the free-cooling operation, the valve 160 may be closed and the valve 162 may be opened to cause the conditioning fluid to bypass the evaporator 108. In the mechanical-cooling operation and the hybrid-cooling operation, the valve 160 may be opened and the valve 162 may be closed such that the conditioning fluid is routed through the evaporator 108. Other valve arrangements are also possible.

Further, the controller 150 may control the valve 140 (e.g., three-way valve) based on the intended operating mode of the chiller system 100. For example, the three-way valve 140 may be configured to receive the refrigerant output by the heat exchanger 118. During the hybrid-cooling operation, the three-way valve 140 may be controlled by the controller 150 to direct at least a portion of the refrigerant to the refrigerant inlet 129 of the distribution header 130. The portion of the refrigerant directed toward the refrigerant inlet 129 of the distribution header 130, which may be in liquid phase, may combine with the vapor phase of the refrigerant output by the compressor 110 of the mechanical-cooling circuit 104. This may enable more balanced pressure characteristics in the fan coil units 102 than would otherwise be possible without the valve 140. Because the additional portion of the refrigerant routed to the refrigerant inlet 129 of the distribution header 130 via the valve 140 may include a liquid phase, a check valve 143 may be employed between the compressor 110 of the mechanical-cooling circuit 104 and the refrigerant inlet 129 of the distribution header 130, where the check valve 143 blocks ingress of the liquid phase of the refrigerant into the compressor 110.

Figure 3:
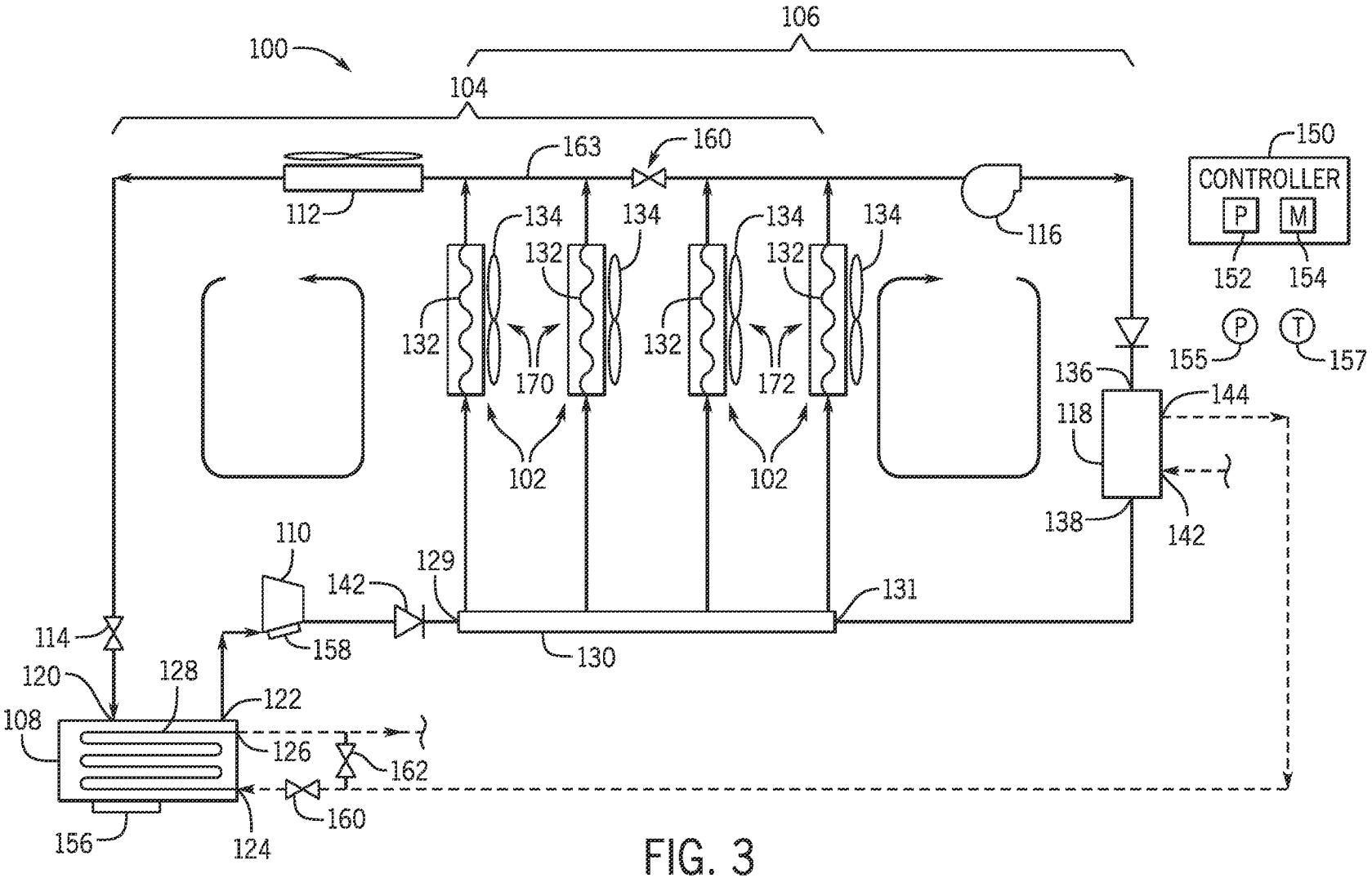
FIG. 3 is a schematic illustration of an embodiment of a chiller system for use in the HVAC&R system of FIG. 1, the chiller system having fan coil units configured to receive a refrigerant from a mechanical-cooling circuit and from a free-cooling circuit, in accordance with an aspect of the present disclosure.

FIG. 3 is a schematic illustration of an embodiment of the chiller system 100 for use in the HVAC&R system 10 of FIG. 1 and having the fan coil units 102 configured to receive refrigerant from the mechanical-cooling circuit 104 and the free-cooling circuit 106. The chiller system 100 of FIG. 3 is similar to the chiller system 100 of FIG. 2. However, the chiller system 100 of FIG. 3 does not include the valve 140 of FIG. 2 and instead includes a valve 160 disposed at an outlet header 163 downstream from the fan coil units 102. The valve 160 may be selectively opened and closed based on the operating mode of the chiller system 100. For example, in the mechanical-cooling operation, the valve 160 is opened, the compressor 110 is powered, and the pump 116 is unpowered. All the fan coil units 102 may be used to receive the refrigerant from the distribution header 130 downstream the compressor 110 of the mechanical-cooling circuit 104. While the valve 160 is open and the chiller system 100 is controlled to the mechanical-cooling operation, the refrigerant may pass from the distribution header 130, through the fan coil units 102, through the outlet header 163 (e.g., where a portion of the refrigerant passes through the valve 160), and toward the subcooler 112.

In the free-cooling operation, the valve 160 is opened, the compressor 110 is unpowered, and the pump 116 is powered. All the fan coil units 102 may be used to receive the refrigerant from the distribution header 130 downstream from the heat exchanger 118 of the free-cooling circuit 106. While the valve 160 is open and the chiller system 100 is controlled to the free-cooling operation, the refrigerant may pass from the distribution header 130, through the fan coil units 102, through the outlet header 163 (e.g., where a portion of the refrigerant passes through the valve 160), and toward the pump 116.

In the hybrid-cooling operation, the valve 160 is closed, the compressor 110 is powered, and the pump 116 is powered. While the valve 160 is closed, a first portion 170 of the fan coil units 102 may be used as condensers of the mechanical-cooling circuit 104, and a second portion 172 of the fan coil units 102 may be used as free-cooling coils of the free-cooling circuit 106. The valve 160, while closed, may operate to direct the refrigerant from the first portion 170 of the fan coil units 102 toward the subcooler 112 of the mechanical-cooling circuit 104, and from the second portion 172 of the fan coil units 102 toward the pump 116 of the free-cooling circuit 106. Further, the distribution header 130 may be sloped such that the additional refrigerant inlet 131 (e.g., configured to receive the refrigerant in liquid phase from the heat exchanger 118) is lower, relative to a direction of gravity, than the refrigerant inlet 129 (e.g., configured to receive the refrigerant in vapor phase from the compressor 110). By sloping the distribution header 130 as described above, mixing of the liquid phase and vapor phase refrigerant may be reduced. To the extent mixing occurs and/or backflow of the liquid phase of the refrigerant travels from the distribution header 130 toward the compressor 110, the check valve 143 may be employed to block ingress of liquid into the compressor 110.

Figure 4:
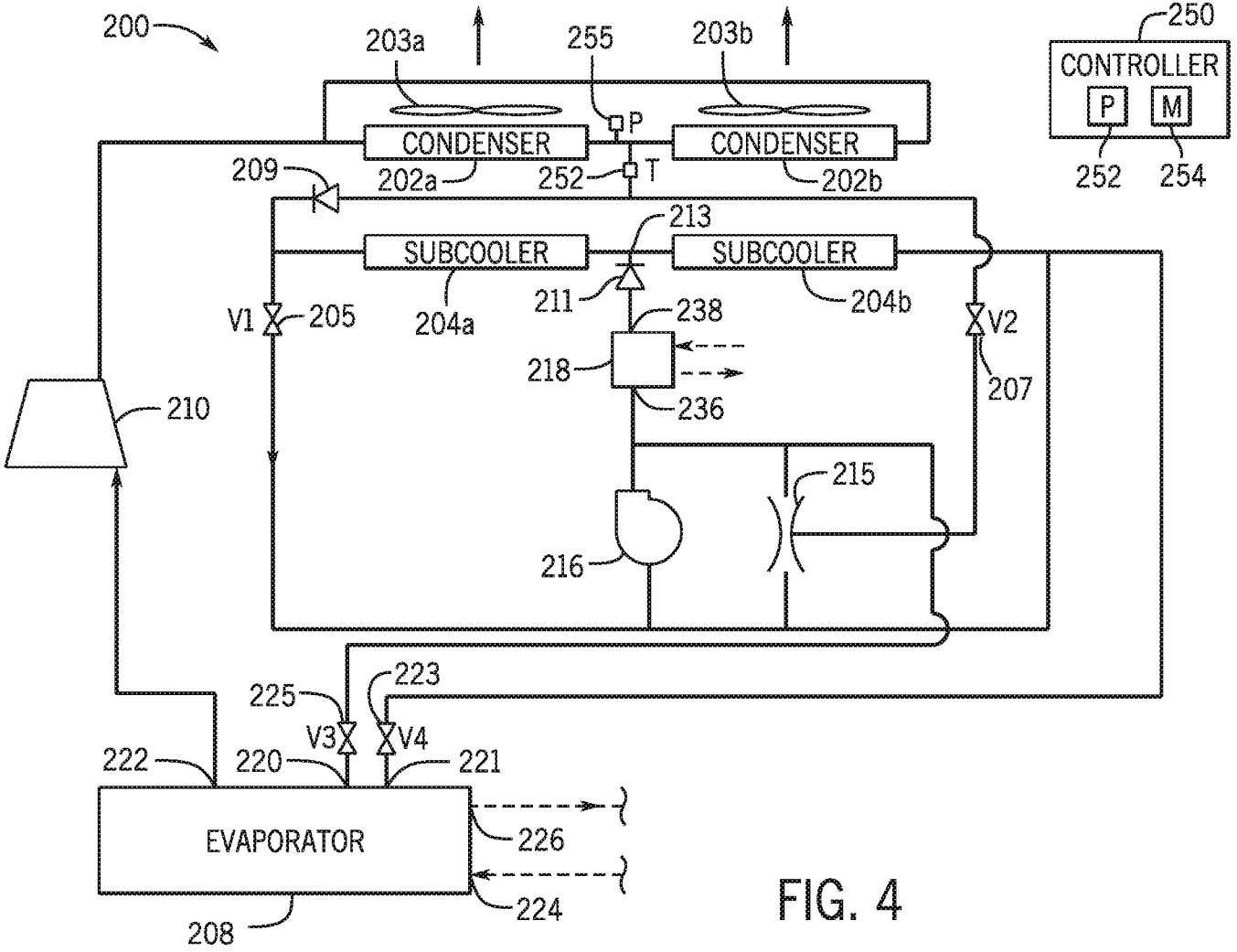
FIG. 4 is a schematic illustration of an embodiment of a chiller system for use in the HVAC&R system of FIG. 1, the chiller system having condenser coils and having subcooler coils configured to receive a refrigerant in parallel or in series depending on an operating mode of the chiller system, in accordance with an aspect of the present disclosure.

FIG. 4 is a schematic illustration of an embodiment of a chiller system 200 for use in the HVAC&R system 10 of FIG. 1, the chiller system 200 having condenser coils 202*a*, 202*b* and having subcooler coils 204*a*, 204*b* configured to receive a refrigerant in parallel or in series with one another depending on an operating mode of the chiller system 200. For example, in a mechanical-cooling operation, the condenser coils 202*a*, 202*b* are configured to receive the refrigerant in parallel and the subcooler coils 204*a*, 204*b* are configured to receive the refrigerant in series. Indeed, a first valve 205 and a second valve 207 of the chiller system 200 may be closed in the mechanical-cooling operation to force the refrigerant exiting the condenser coils 202*a*, 202*b* through a check valve 209 and then through the subcooler coil 204*a*, 204*b* in series (e.g., through the first subcooler coil 204*a* and then through the second subcooler coil 204*b*). Air is moved by a first fan 203*a* to provide flow through the first subcooler coil 204*a* and the first condenser coil 202*a*, and by a second fan 203*b* to provide flow through the second subcooler coil 204*b* and the second condenser coil 202*b*. In some embodiments, air flow through the coils is preferably in series with ambient air flowing first through the subcooler coils 204*a*, 204*b* and then the condenser coil 202*a*, 202*b*, respectively. Alternatively, separate fans may be used for the coils (e.g., the first condenser coil 202*a* may include a dedicated fan, the second condenser coil 202*b* may include a dedicated fan, the first subcooler coil 204*a* may include a dedicated fan, and the second subcooler coil 204*b* may include a dedicated fan). In some embodiments, the fans 203*a*, 203*b* preferably draw air through the coils and discharges air upwards, although the fans 203*a*, 203*b* may be arranged differently to draw air through the coils and discharge air downwardly in another embodiment. Another check valve 211 disposed downstream from a juncture 213 between the subcooler coils 204*a*, 204*b* may block a flow of refrigerant therethrough during the mechanical-cooling operation, thereby forcing the refrigerant from the first subcooler coil 204*a* to the second subcooler coil 204*b*. The refrigerant may then flow toward an inlet 221 of the evaporator 208. A valve 223 may be opened during the mechanical-cooling operation to enable the flow of the refrigerant to the inlet 221 of the evaporator 208. During the mechanical-cooling operation, an additional valve 225 may be closed to block flow of the refrigerant to an additional inlet 220 of the evaporator 208. Further, during the mechanical-cooling operation, a pump 216 associated with free-cooling may be unpowered.

During a free-cooling operation of the chiller system 200, aspects of the chiller system 200 may be controlled to enable the refrigerant to flow through the subcooler coils 204*a*, 204*b* in parallel. For example, the compressor 210 may be unpowered or powered at a minimum or reduced setting, and the pump 216 may be powered. In the case that the compressor 210 is a magnetic-bearing centrifugal compressor, the bearings are preferably energized to levitate the impeller to allow the impeller to rotate freely and to reduce resistance to flow of refrigerant vapor. Further, the valve 207 may be opened such that refrigerant exiting the condenser coils 202*a*, 202*b* may flow through the valve 207. The refrigerant may be drawn or biased from the condenser coils 202*a*, 202*b* through the valve 207 via an eductor 215. The pump 216 of the chiller system 200 may operate to move the refrigerant (e.g., in a liquid phase) from the eductor 215 toward an inlet 236 of a heat exchanger 218, which may be a brazed plate heat exchanger configured to cool a conditioning fluid via the refrigerant, where the conditioning fluid is routed to an inlet 224 of the evaporator 208, passed through the evaporator 208 and coiled by the refrigerant in the evaporator 208, and then output through an outlet 226 of the evaporator 208 and toward a load (e.g., preferably through the heat exchanger 218 so that the heat exchanger 218 is downstream of the evaporator 208). This flow configuration has the advantage of keeping the evaporator 208 at a higher temperature and pressure to assure that the pump 216 and related piping are full of refrigerant liquid. Alternatively, the heat exchanger 218 may be in parallel or upstream of the evaporator 208, which may improve performance at some conditions but may cause a higher likelihood of two-phase flow through the pump 216 at some operating conditions.

While the refrigerant is generally directed by the pump 216 toward the subcooler coils 204*a*, 204*b* during the free-cooling operation, a portion of the refrigerant may be directed from the pump 216 toward the additional valve 225, which is opened in the free-cooling operation to cause the portion of the refrigerant to pass to the additional inlet 220 of the evaporator 208. A remaining portion of the refrigerant that is not directed toward the additional valve 225 and additional inlet 220 of the evaporator 208 may be biased by the pump 216 through the check valve 211 toward the subcooler coils 204*a*, 204*b*. Further, one portion of the refrigerant may flow from the juncture 213 between the subcooler coils 204*a*, 204*b* toward the first subcooler coil 204*a* and another portion of the refrigerant may flow from the juncture 213 toward the second subcooler coil 204*b*, such that the subcooler coils 204*a*, 204*b* are operated in parallel during the free-cooling operation. The refrigerant may then flow toward the valve 223 and the inlet 221 of the evaporator 208. The refrigerant received by the inlets 220, 221 of the evaporator 208 may be used to cool the conditioning fluid received by the inlet 224 of the evaporator 208 from the heat exchanger 218. When the chiller system 200 is controlled the hybrid-cooling operation, the chiller system 200 is controlled similarly to the free-cooling operation except that the compressor 210 is energized during the hybrid-cooling operation to assist movement of the refrigerant (e.g., in vapor phase) to the condenser coils 202*a*, 202*b*.

A controller 250 (e.g., control system) of the chiller system 200 includes processing circuitry 252 and a memory 254 (e.g., non-transitory, computer-readable media) storing instructions thereon that, when executed by the processing circuitry 252, cause the controller 250 to perform various functions. A pressure sensor 255 and a temperature sensor 257 (e.g., disposed adjacent the condenser coils 202*a*, 202*b*) may provide data feedback to the controller 250 at various intervals. The controller 250 may determine an operating mode (e.g., the mechanical-cooling operation, the free-cooling operation, or the hybrid-cooling operation) of the chiller system 200 based on the sensor feedback from the pressure sensor 255 and from the temperature sensor 257, and in some embodiments from other data or sensor feedback. For example, the above-described control of the valves 205, 207, 223, 225 may be determined or dictated by the controller 250. Further, the power setting of the compressor 210 and the pump 216 may be determined or dictated by the controller 250.

Figure 5:
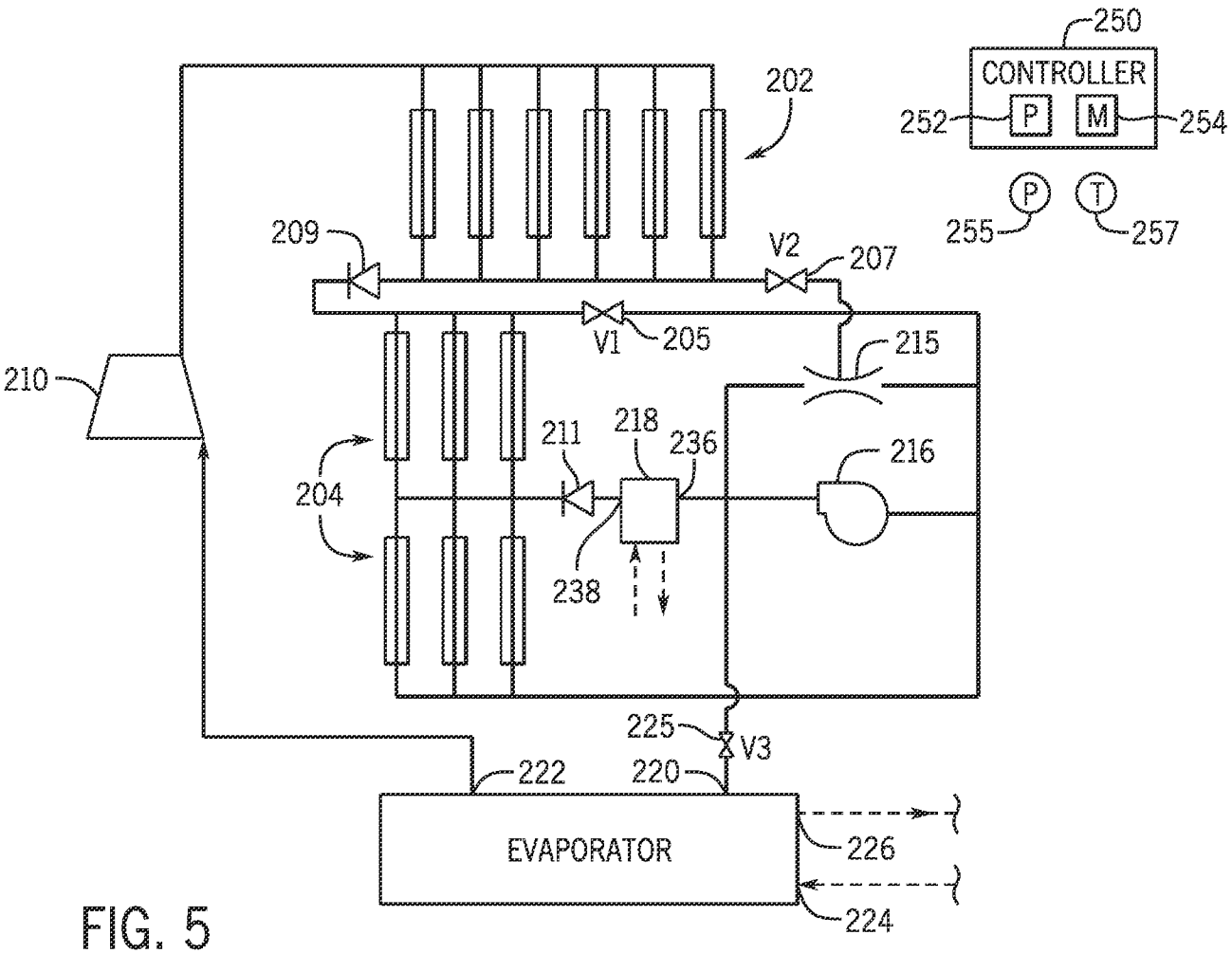
FIG. 5 is a schematic illustration of an embodiment of a chiller system for use in the HVAC&R system of FIG. 1, the chiller system having condenser coils and having subcooler coils configured to receive a refrigerant in parallel or in series depending on an operating mode of the chiller system, in accordance with an aspect of the present disclosure.

FIG. 5 is a schematic illustration of an embodiment of the chiller system 200 for use in the HVAC&R system 10 of FIG. 1, the chiller system 200 having the condenser coils 202 and having the subcooler coils 204 configured to receive a refrigerant in parallel or in series depending on an operating mode of the chiller system 200. The embodiment in FIG. 5 is similar to the embodiment in FIG. 4. However, the embodiment in FIG. 5 includes six condenser coils 202 and six subcooler coils 204, and includes a single refrigerant inlet 220 and corresponding valve 225. Any number of the condenser coils 202 and the subcooler coils 204 may be possible. It should be noted that, for sake of simplicity, the six condenser coils 202*a* and the six subcooler coils 202*b* are offset from one another in the schematic illustration of FIG. 5, but it should be understood that the six condenser coils 202 and the six subcooler coils 204 may be arranged similar to the arrangement in FIG. 4, such that a single fan is shared between pairs or groups of condenser coils 202 and subcooler coils 204. That is, in the illustrated embodiment, six fans may be used, such that each fan biases an airflow over one of the condenser coils 202 and one of the subcooler coils 204. Further, the valve 225 may be controlled to modulate refrigerant flow to the evaporator 208.

Figure 6:
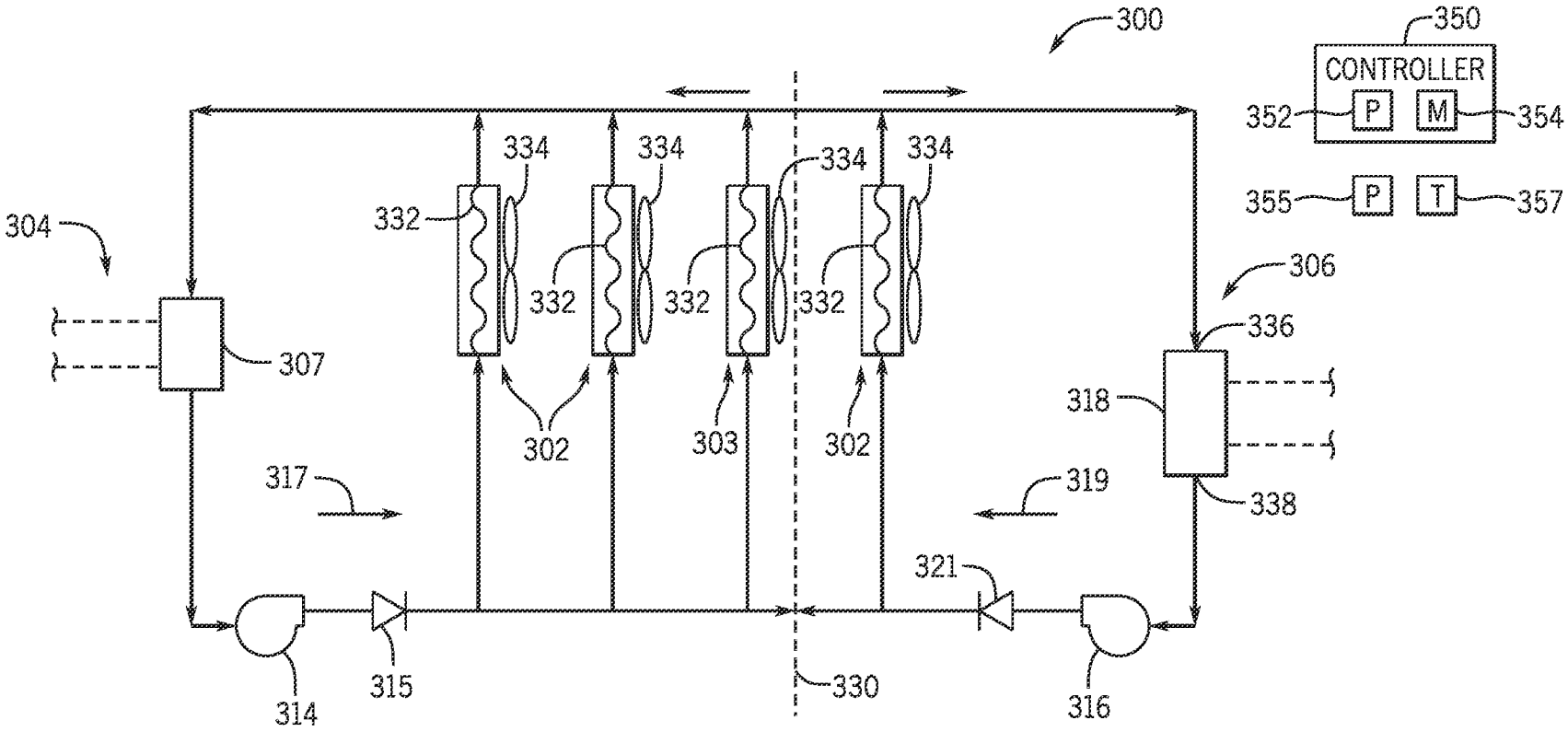
FIG. 6 is a schematic illustration of an embodiment of a chiller system for us in the HVAC&R system of FIG. 1, the chiller system having fan coil units configured to receive glycol routed through a condenser of a mechanical-cooling circuit and a heat exchanger of a free-cooling circuit, in accordance with an aspect of the present disclosure.

FIG. 6 is a schematic illustration of an embodiment of a chiller system 300 for use in the HVAC&R system 10 of FIG. 1, the chiller system 300 having fan coil units 302 configured to receive a fluid (e.g., glycol, or a mixture of water and glycol) routed through a condenser 307 of a mechanical-cooling circuit 304 and a heat exchanger 318 of a free-cooling circuit 306. While the condenser 307 of the mechanical-cooling circuit 304 is shown and other features of the mechanical-cooling circuit 304 (e.g., an evaporator and compressor) are not shown, it should be understood that the mechanical-cooling circuit 304 may include an evaporator, a compressor, and other features described with reference to other drawings of the present disclosure.

In the illustrated embodiment, a first pump 314 may be configured to draw the fluid (e.g., the water, or the mixture of water and glycol, or other liquid) from the condenser 307 and bias the fluid through a check valve 315 toward the fan coil units 302. In this way, the pump 314 may bias the fluid in a first direction 317 through a loop corresponding to the mechanical-cooling circuit 304. A portion of the fan coil units 302 may receive the fluid biased by the pump 314 in coils 332 thereof, cool the fluid via fans 334 thereof, and direct the fluid back toward the condenser 307 of the mechanical-cooling circuit, where the fluid is used to cool a refrigerant passing through the condenser 307 and associated with the mechanical-cooling circuit 304. The refrigerant may then be biased through the mechanical-cooling circuit 304 to an evaporator (not shown), where the refrigerant is used to chill a conditioning fluid delivered to a load (e.g., downstream equipment, such as an air handler).

A second pump 316 may be configured to bias the fluid in a second direction 319 opposing the first direction 317. For example, the pump 316 may draw the fluid from an outlet 338 of the heat exchanger 318 of the free-cooling circuit 306 and bias the fluid through a check valve 321 toward the fan coil units 302. The fan coil units 302 may receive the fluid in coils 332 thereof, cool the fluid via fans 334 thereof, and direct the fluid back toward an inlet 336 of the heat exchanger 318. The fluid may be used by the heat exchanger 318 to cool a conditioning fluid, which may be delivered to a load or routed to an evaporator (not shown) of the mechanical-cooling circuit 304 for further chilling prior to being delivered to the load.

A flow boundary 330 between the fluid loop associated with the condenser 307 of the mechanical-cooling circuit 304 and the fluid loop associated with the heat exchanger 318 of the free-cooling circuit 306 may determine how many of the fan coil units 302 are used to cool the fluid for delivery to the condenser 307 and how many of the fan coil units 302 are used to cool the fluid for delivery to heat exchanger 318. In the illustrated embodiment, the flow boundary 330 causes three of the fan coil units 302 to receive the fluid from the first pump 314 and direct the fluid to the condenser 307 and one fan coil unit 302 to receive the fluid from the second pump 316 and direct the fluid to the heat exchanger 318. The number of fan coil units 302 dedicated to the condenser 307 and the number of fan coil units 302 dedicated to the heat exchanger 318, defined by the flow boundary 330, may be changed based on control from a controller 350 (e.g., control system). The controller 350 includes processing circuitry 352 and a memory 354 (e.g., non-transitory, computer-readable media) having instructions stored thereon that, when executed by the processing circuitry 352, cause the controller 350 to perform various functions. In some embodiments, the controller 350 receives sensor feedback from a pressure sensor 355 and a temperature sensor 357 configured to detect a pressure and a temperature, respectively, of the refrigerant, the fluid (e.g., glycol, or mixture of water and glycol), ambient air, or the conditioning fluid. Liquid level sensors, level switches or pressure and temperature sensors to confirm subcooling may be included to avoid negative effects on the pump from cavitation or running dry due lack of refrigerant liquid. The controller 350 may control, for example, a setting or speed of the first pump 314 and the second pump 316 to dictate the location of the flow boundary 330 and, thus, the number of fan coil units 302 dedicated to the condenser 307 and to the heat exchanger 318.

Figure 7:
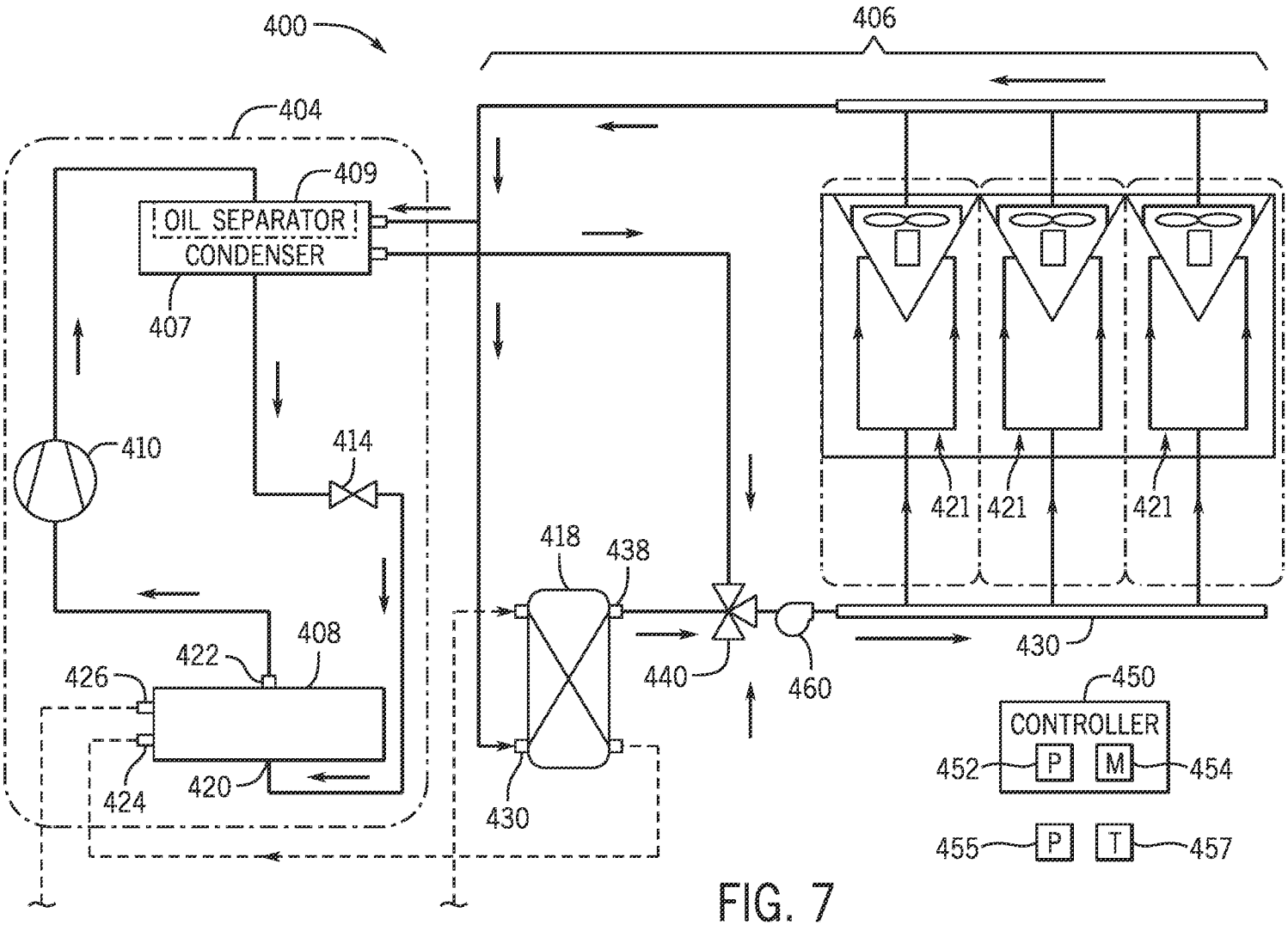
FIG. 7 is a schematic illustration of an embodiment of a chiller system for us in the HVAC&R system of FIG. 1, the chiller system having a free-cooling circuit configured to route glycol (or a mixture of water and glycol) between a heat exchanger, a dry tower, and a condenser of a mechanical-cooling circuit, in accordance with an aspect of the present disclosure.

FIG. 7 is a schematic illustration of an embodiment of a chiller system 400 for use in the HVAC&R system 10 of FIG. 1, the chiller system 400 having a free-cooling circuit 406 configured to route a fluid (e.g., glycol, or a mixture of water and glycol) between a heat exchanger 418, a number of dry towers 421, and a condenser 407 of a mechanical-cooling circuit 404. "Dry tower" refers to a structure or tower that conducts heat transfer through air-cooled heat exchangers without direct contact between the cooling air and the fluid (e.g., glycol, or mixture of water and glycol). The mechanical-cooling circuit 404 includes the condenser 407 at which the fluid (e.g., glycol, or mixture of water and glycol) cools the refrigerant circulated through the mechanical-cooling circuit 404, a compressor 410 configured to bias the refrigerant through the mechanical-cooling circuit 404, an expansion valve 414 configured to expand the refrigerant, and an evaporator 408 that receives the refrigerant from the expansion valve 414. In embodiments where the compressor 410 includes an oil-injected screw compressor, the condenser 407 may include an oil separator 409. The evaporator 408 may include a refrigerant inlet 420 configured to receive the refrigerant from the expansion valve 414, a refrigerant outlet 422 configured to output the refrigerant toward the compressor 410, a conditioning fluid inlet 424 configure to receive a conditioning fluid, and a conditioning fluid outlet 426 configured to output the conditioning fluid toward a load (e.g., downstream equipment, such as an air handler). In general, the evaporator 408 may utilize the refrigerant to chill the conditioning fluid to adequate temperatures for delivery to the load.

The evaporator 408 may receive the conditioning fluid from a heat exchanger 418 of the free-cooling circuit 406, where the heat exchanger 418 chills the conditioning fluid prior to delivery of the conditioning fluid to the evaporator 408. For example, the free-cooling circuit 406 may include dry towers 421 configured to generate an air flow that cools the fluid (e.g., glycol, or mixture of water and glycol) routed through the free-cooling circuit 406. The fluid may be biased toward the dry towers 421 via a pump 460. The fluid may then be routed to the heat exchanger 418 of the free-cooling circuit 406 and/or the condenser 407 of the mechanical-cooling circuit 404. The fluid may be used in the condenser 407 to cool the refrigerant associated with the mechanical-cooling circuit 404, as previously described, and may be used in the heat exchanger 418 to chill the conditioning fluid. For example, the heat exchanger 418 includes an inlet 436 configured to receive the fluid (e.g., glycol, or mixture of water and glycol) from the dry towers 421 and an outlet 438 configured to output the fluid toward a valve 440 (e.g., proportional valve). The inlet 436 and the outlet 438 may be arranged (e.g., catty-corner to one another) to enable counterflow between the fluid (e.g., glycol, or mixture of water and glycol) and the conditioning fluid, as shown. The fluid may also be output from the condenser 407 toward the valve 440. The valve 440 may receive the fluid from both the heat exchanger 418 and the condenser 407 and direct the fluid back toward the dry towers 421. The dry towers 421 may receive the fluid in parallel via a distribution header 430.

As described with respect to previous embodiments, a controller 450 (e.g., control system) having processing circuitry 452 and a memory 454 (e.g., non-transitory, computer-readable media) may be employed to control aspects of the illustrated chiller system 400. For example, the controller 450 may receive sensor feedback from a pressure sensor 455 and/or a temperature sensor 457 (e.g., indicative of pressure and temperature of the refrigerant, the fluid [glycol or mixture of water and glycol], and/or the conditioning fluid), and may control aspects of the chiller system 400 based on the sensor feedback. For example, during mechanical-cooling operation of the chiller system 400, the controller 450 may control the valve 440 (e.g., proportional valve) such that all the fluid in the free-cooling circuit 406 is directed to the condenser 407 and not the heat exchanger 418. During free-cooling operation, the controller 450 may control the valve 440 such that all the fluid in the free-cooling circuit 406 is directed to the heat exchanger 418 and not the condenser 407. During hybrid-cooling operation, the controller 450 may control the valve 440 such that a portion of the fluid (e.g., glycol) is directed toward the condenser 407 and an additional portion of the fluid (e.g., a mixture of glycol and water) is directed toward the heat exchanger 418. In any of the above-described embodiments, a speed or power setting of the pump 460 may be controlled via the controller 450 to adequately bias the fluid about the free-cooling circuit 406.

Figure 8:
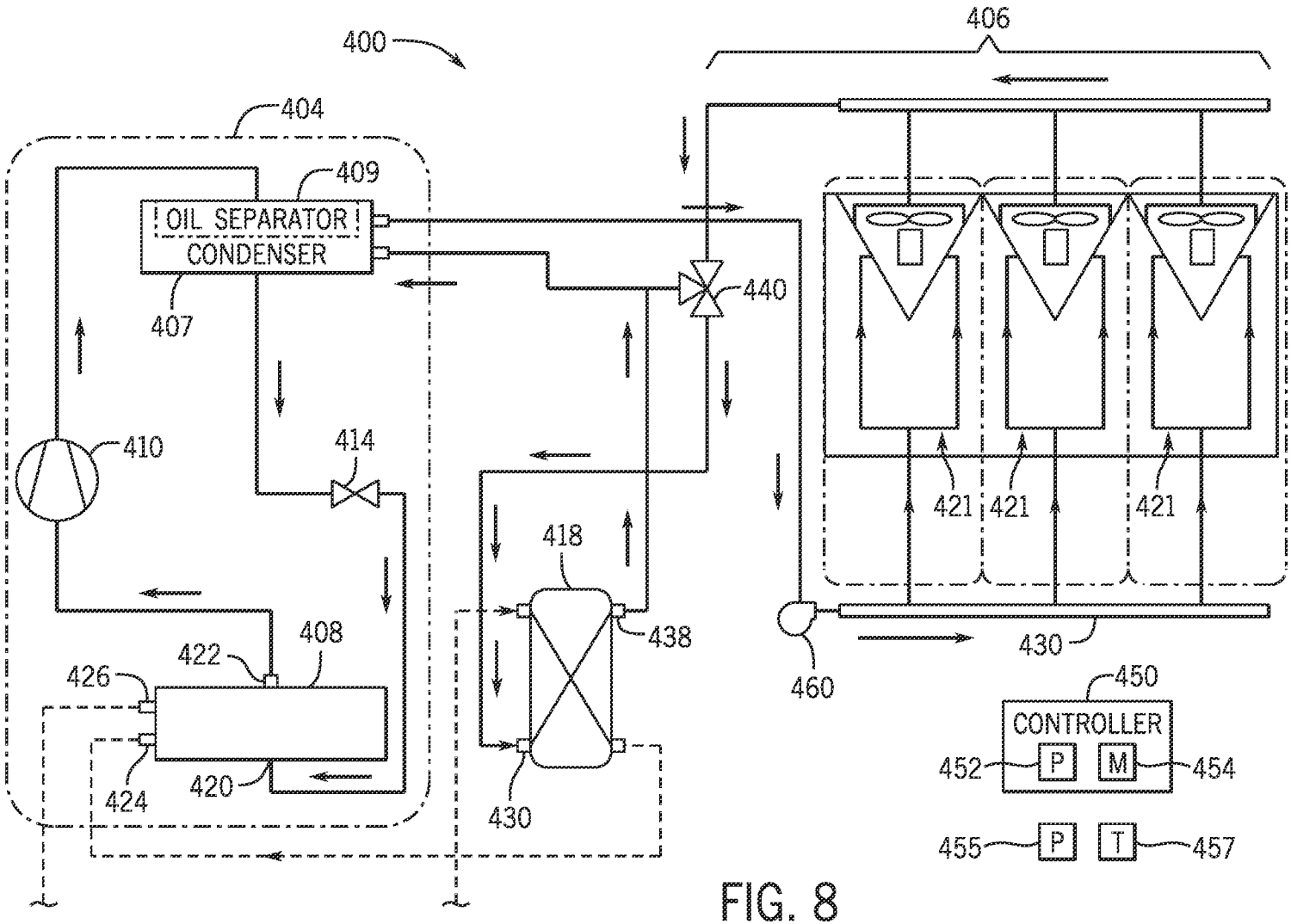
FIG. 8 is a schematic illustration of an embodiment of a chiller system for us in the HVAC&R system of FIG. 1, the chiller system having a free-cooling circuit configured to route glycol (or a mixture of water and glycol) between a heat exchanger, a dry tower, and a condenser of a mechanical-cooling circuit, in accordance with an aspect of the present disclosure.

FIG. 8 is a schematic illustration of an embodiment of the chiller system 400 for use in the HVAC&R system 10 of FIG. 1, the chiller system 400 having the free-cooling circuit 406 configured to route glycol (or a mixture of water and glycol) between the heat exchanger 418, the dry towers 421, and the condenser 407 of the mechanical-cooling circuit 404. The embodiment in FIG. 8 is similar to the embodiment in FIG. 7. However, in the illustrated embodiment, the valve 440 (e.g., proportional valve) is configured to receive the fluid (e.g., glycol, or mixture of water and glycol) from the dry towers 421 and output the fluid to the condenser 407, the heat exchanger 418, or both. For example, in the mechanical-cooling operation, the valve 440 may be controlled (e.g., by the controller 450) to direct the fluid to the condenser 407 and not the heat exchanger 418. In the free-cooling operation, the valve 440 may be controlled to direct the fluid to the heat exchanger 418 and not the condenser 407. In the hybrid-cooling operation, the valve 440 may be controlled to direct a portion of the fluid to the condenser 407 and a portion of the fluid to the heat exchanger 418. The fluid received by the inlet 436 of the heat exchanger 418 may pass through the heat exchanger 418 to chill the conditioning fluid, may be output through the outlet 438 of the heat exchanger, and may be directed toward the condenser 407. The fluid received by the condenser 407 (e.g., from the heat exchanger 418 or the valve 440) may cool the refrigerant in the condenser 407 prior to delivery of the fluid from the condenser 407 to the dry towers 421. The inlet 436 and the outlet 438 may be arranged (e.g., catty-corner to one another) to enable counterflow between the fluid (e.g., glycol, or mixture of water and glycol) and the conditioning fluid, as shown.

Technical benefits associated with the presently disclosed embodiments include reduced manufacturing costs, increased performance, increased versatility, relatively less complex arrangements, relatively less complex installation procedures, and relatively less complex maintenance procedures of chiller systems, relative to conventional embodiments.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A chiller system, comprising:

a first condenser coil;

a second condenser coil;

a first subcooler coil;

a second subcooler coil;

a control system configured to:

cause, in response to a mechanical-cooling operation of the chiller system, a refrigerant to flow through the first condenser coil and the second condenser coil in parallel, and then through the first subcooler coil and the second subcooler coil in series; and cause, in response to a free-cooling operation of the chiller system, the refrigerant to flow through the first subcooler coil and the second subcooler coil in parallel; and an eductor configured to draw the refrigerant from the first condenser coil, the second condenser coil, or both in response to the free-cooling operation and a hybrid-cooling operation.

2. The chiller system of claim 1, comprising:

a first fan associated with the first condenser coil and the first subcooler coil; and a second fan associated with the second condenser coil and the second subcooler coil.

3. The chiller system of claim 1, wherein the control system is configured to cause, in response to the hybrid-cooling operation of the chiller system, the refrigerant to flow through the first subcooler coil and the second subcooler coil in series.

4. The chiller system of claim 3, comprising a compressor configured to compress the refrigerant and deliver the refrigerant to the first condenser coil, wherein the control system is configured to:

enable a powering of the compressor in response to the mechanical-cooling operation and the hybrid-cooling operation; and block a powering of the compressor in response to the free-cooling operation.

5. The chiller system of claim 4, wherein the compressor is positioned between the first condenser coil and an evaporator relative to a flow of the refrigerant.

6. The chiller system of claim 1, comprising a heat exchanger in fluid communication with the eductor relative to a flow of the refrigerant, wherein the heat exchanger is configured to place the refrigerant in a heat exchanging relationship with a flow of conditioning fluid during the free-cooling operation and the hybrid-cooling operation.

7. The chiller system of claim 6, wherein the heat exchanger is a brazed plate heat exchanger.

8. The chiller system of claim 1, comprising:

a pump, wherein the control system is configured to power the pump in response to the free-cooling operation and the hybrid-cooling operation;

a first valve positioned between the second subcooler coil and a first inlet of an evaporator of the chiller system, wherein the control system is configured to cause the first valve to be open in response to the mechanical-cooling operation and the hybrid cooling operation, and wherein the control system is configured to cause the first valve to be closed in response to the free-cooling operation; and a second valve positioned between the pump and a second inlet of the evaporator, wherein the control system is configured to cause the second valve to be open in response to the free-cooling operation, and wherein the control system is configured to cause the second valve to be closed in response to the mechanical-cooling operation.

9. The chiller system of claim 8, comprising:

a juncture positioned between the first subcooler coil and the second subcooler coil; and a check valve positioned between the pump and the juncture, wherein the check valve is configured to block a flow of the refrigerant from the pump during the mechanical-cooling operation.

10. The chiller system of claim 1, comprising a sensor configured to detect a parameter of the chiller system, wherein the control system is configured to select the mechanical-cooling operation or the free-cooling operation based at least in part on the parameter.

11. The chiller system of claim 10, wherein the sensor comprises a pressure sensor.

12. The chiller system of claim 10, wherein the sensor comprises a temperature sensor.

13. The chiller system of claim 1, comprising an evaporator configured to establish a heat exchange relationship between the refrigerant and a conditioning fluid.

14. A chiller system, comprising:

a first condenser coil;

a second condenser coil;

a first subcooler coil;

a second subcooler coil;

a pump;

a first valve positioned between the second subcooler coil and a first inlet of an evaporator of the chiller system;

a second valve positioned between the pump and a second inlet of the evaporator; and a control system configured to:

cause, in response to a mechanical-cooling operation of the chiller system, a refrigerant to flow through the first condenser coil and the second condenser coil in parallel, and then through the first subcooler coil and the second subcooler coil in series;

cause the first valve to be open in response to the mechanical-cooling operation;

cause the second valve to be closed in response to the mechanical-cooling operation;

cause, in response to a free-cooling operation of the chiller system, the refrigerant to flow through the first subcooler coil and the second subcooler coil in parallel;

cause the first valve to be closed in response to the free-cooling operation;

cause the second valve to be open in response to the free-cooling operation; and power the pump in response to the free-cooling operation and a hybrid-cooling operation.

15. The chiller system of claim 14, wherein the control system is configured to cause, in response to the hybrid-cooling operation, the refrigerant to flow through the first subcooler coil and the second subcooler coil in series.

16. The chiller system of claim 14, comprising:

a juncture positioned between the first subcooler coil and the second subcooler coil; and a check valve positioned between the pump and the juncture, wherein the check valve is configured to block a flow of the refrigerant from the pump during the mechanical-cooling operation.

17. The chiller system of claim 14, comprising:

a first fan associated with the first condenser coil and the first subcooler coil; and a second fan associated with the second condenser coil and the second subcooler coil.

18. The chiller system of claim 14, comprising a compressor configured to compress the refrigerant and deliver the refrigerant to the first condenser coil, wherein the control system is configured to:

enable a powering of the compressor in response to the mechanical-cooling operation and the hybrid-cooling operation; and block a powering of the compressor in response to the free-cooling operation.

19. The chiller system of claim 18, wherein the compressor is positioned between the first condenser coil and the evaporator relative to a flow of the refrigerant.

20. The chiller system of claim 14, comprising a sensor configured to detect a parameter of the chiller system, wherein the control system is configured to select the mechanical-cooling operation, the free-cooling operation, or the hybrid-cooling operation based at least in part on the parameter.

* * * * *